US009885131B2

(12) United States Patent
Naka et al.

(10) Patent No.: US 9,885,131 B2
(45) Date of Patent: Feb. 6, 2018

(54) SEWING MACHINE

(71) Applicant: BROTHER KOGYO KABUSHIKI KAISHA, Nagoya-shi, Aichi-ken (JP)

(72) Inventors: Takafumi Naka, Ama (JP); Masayuki Hori, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 266 days.

(21) Appl. No.: 14/529,583

(22) Filed: Oct. 31, 2014

(65) Prior Publication Data

US 2015/0128835 A1 May 14, 2015

(30) Foreign Application Priority Data

Nov. 13, 2013 (JP) ..... 2013-235284

(51) Int. Cl.
*D05B 19/12* (2006.01)
*D05C 5/02* (2006.01)

(52) U.S. Cl.
CPC ..... *D05B 19/12* (2013.01); *D05C 5/02* (2013.01)

(58) Field of Classification Search
CPC ..... D05B 19/12; D05B 19/02; D05B 19/08; D05B 19/10; D05B 19/14; D05B 19/16; D05C 5/02
USPC ..... 700/136–138; 112/102.5, 80.23, 277, 112/470.01, 470.03, 470.04, 470.06, 112/475.02, 475.19
See application file for complete search history.

(56) References Cited

U.S. PATENT DOCUMENTS 5,399,410 A * 3/1995 Urase ..... D05C 1/08 112/439
6,004,018 A * 12/1999 Kawasato ..... D05B 19/10 700/131
6,370,442 B1 * 4/2002 Wang ..... D05B 19/12 112/102.5
8,948,901 B2 * 2/2015 Tokura ..... D05B 19/08 112/102.5
9,080,268 B2 * 7/2015 Yamada ..... D05C 5/02
9,249,533 B2 * 2/2016 Imaizumi ..... D05B 19/08
2006/0015209 A1 * 1/2006 Schweizer ..... D05B 19/02 700/136
2007/0204779 A1 * 9/2007 Naka ..... D05B 65/00 112/470.04
2008/0017090 A1 * 1/2008 Tashiro ..... D05B 19/14 112/102.5

(Continued)

FOREIGN PATENT DOCUMENTS

JP A-2004-33324 2/2004
JP A-2010-213748 9/2010
JP A-2011-5180 1/2011

*Primary Examiner* — Danny Worrell
(74) *Attorney, Agent, or Firm* — Oliff PLC

(57) ABSTRACT

A sewing machine acquires sewing data to sew a cross stitch pattern. The sewing machine sets a planned sewing position of the cross stitch pattern. The sewing machine identities a position of at least one interstice on the sewing workpiece based on the generated image data. The sewing machine determines a sewing: position of the cross stitch pattern based on the set planned sewing position, and on the identified position of the at least one interstice. The sewing machine corrects the sewing data based on the determined sewing position. The sewing machine drives the sewing mechanism and the movement mechanism based on the corrected sewing data, such that the cross stitch pattern is sewn on the sewing workpiece.

4 Claims, 8 Drawing Sheets

(56) References Cited

U.S. PATENT DOCUMENTS

2010/0234979 A1* 9/2010 Katano ..... D05C 5/04 700/138
2010/0242817 A1* 9/2010 Tokura ..... D05B 19/10 112/102.5
2011/0094424 A1* 4/2011 Tokura ..... D05B 19/10 112/102.5
2011/0107950 A1* 5/2011 Takahata ..... D05B 19/10 112/80.23
2011/0146553 A1* 6/2011 Wilhelmsson ..... D05B 19/10 112/475.19
2011/0226171 A1* 9/2011 Tokura ..... D05B 19/10 112/470.05
2011/0295410 A1* 12/2011 Yamada ..... D05B 19/08 700/138
2012/0048163 A1* 3/2012 Tokura ..... D05B 3/06 112/447
2012/0191237 A1* 7/2012 Tokura ..... D05C 5/04 700/138
2012/0222602 A1* 9/2012 Hishida ..... D05B 23/00 112/470.05
2012/0234222 A1* 9/2012 Naka ..... D05B 19/12 112/470.03
2012/0272884 A1* 11/2012 Tokura ..... D05B 19/10 112/470.01
2013/0035780 A1* 2/2013 Abe ..... D05B 19/08 700/138
2013/0074749 A1* 3/2013 Kato ..... D05B 19/02 112/102.5
2013/0112127 A1* 5/2013 Tokura ..... D05B 19/10 112/102.5

* cited by examiner

SEWING MACHINE

CROSS-REFERENCE TO RELATED APPLICATION

This application claims priority to Japanese Patent Application No. 2013-235284 filed on Nov. 13, 2013, the disclosure of which is herein incorporated by reference in its entirety.

BACKGROUND

The present disclosure relates to a sewing machine that is capable of embroidery sewing.

A cross stitch pattern is a pattern that uses an embroidery technique known as cross stitch. A cross stitch is typically formed by two stitches that intersect each other at their respective centers and thus form an X shape. The cross stitch pattern is a pattern in which a desired design is expressed by sewing a plurality of cross stitches side by side on a sewing workpiece. When a user sews a cross stitch pattern by hand, a sewing workpiece exclusively for cross stitching is used. The sewing workpiece exclusively for cross stitching is, for example, a woven fabric formed of warp threads and well threads, and is referred to as a special-purpose cloth. In the special-purpose cloth, intervals between interstices (small holes) that are formed between the warp threads and the well threads are relatively large and are equally spaced. Stitches of the cross stitch pattern are formed such that the interstices of the special-purpose cloth are connected to each other.

A device is known that creates embroidery data to sew a cross stitch pattern using a sewing machine.

SUMMARY

When a cross stitch pattern is sewn by a sewing machine on the above-described special-purpose cloth in accordance with embroidery data, there may be displacement between positions of needle drop points of the cross stitch pattern and the interstices of the special-purpose cloth. However, it is complicated for a user to manually adjust the positions of the needle drop points of the cross stitch pattern and the interstices of the special-purpose cloth.

Various exemplary embodiments of the general principles described herein provide a sewing machine that provides an improved finish when a cross stitch pattern is sewn by the sewing machine on a special-purpose sewing workpiece in accordance with embroidery data.

Exemplary embodiments herein provide a sewing machine having a sewing mechanism, a movement mechanism, an imaging portion, a processor and a memory. The sewing mechanism is configured to be able to sew an embroidery pattern on a sewing workpiece. The movement mechanism is configured such that an embroidery frame that holds the sewing workpiece can be detachably mounted thereon, and is also configured to move the embroidery frame when the embroidery frame is mounted thereon. The imaging portion is configured to capture an image of the sewing workpiece that is held by the embroidery frame, and to generate image data. The memory is configured to store instructions that, when executed by the processor, cause the sewing machine to perform the following processes.

The sewing machine acquires sewing data to sew a cross stitch pattern. The cross stitch pattern is formed by arranging a plurality of cross stitches side by side. Each of the cross stitches are stitches that are formed on two line segments that intersect each other at their respective centers. The sewing machine sets a planned sewing position of the cross stitch pattern. The sewing machine identifies a position of at least one interstice on the sewing workpiece based on the generated image data. The sewing machine determines a sewing position of the cross stitch pattern based on the set planned sewing position, and on the identified position of the at least one interstice. The sewing machine corrects the sewing data based on the determined sewing position. The sewing machine drives the sewing mechanism and the movement mechanism based on the corrected sewing data, such that the cross stitch pattern is sewn on the sewing work piece.

BRIEF DESCRIPTION OF THE DRAWINGS

Exemplary embodiments will be described below in detail with reference to the accompanying drawings in which.

DETAILED DESCRIPTION

Figure 1:
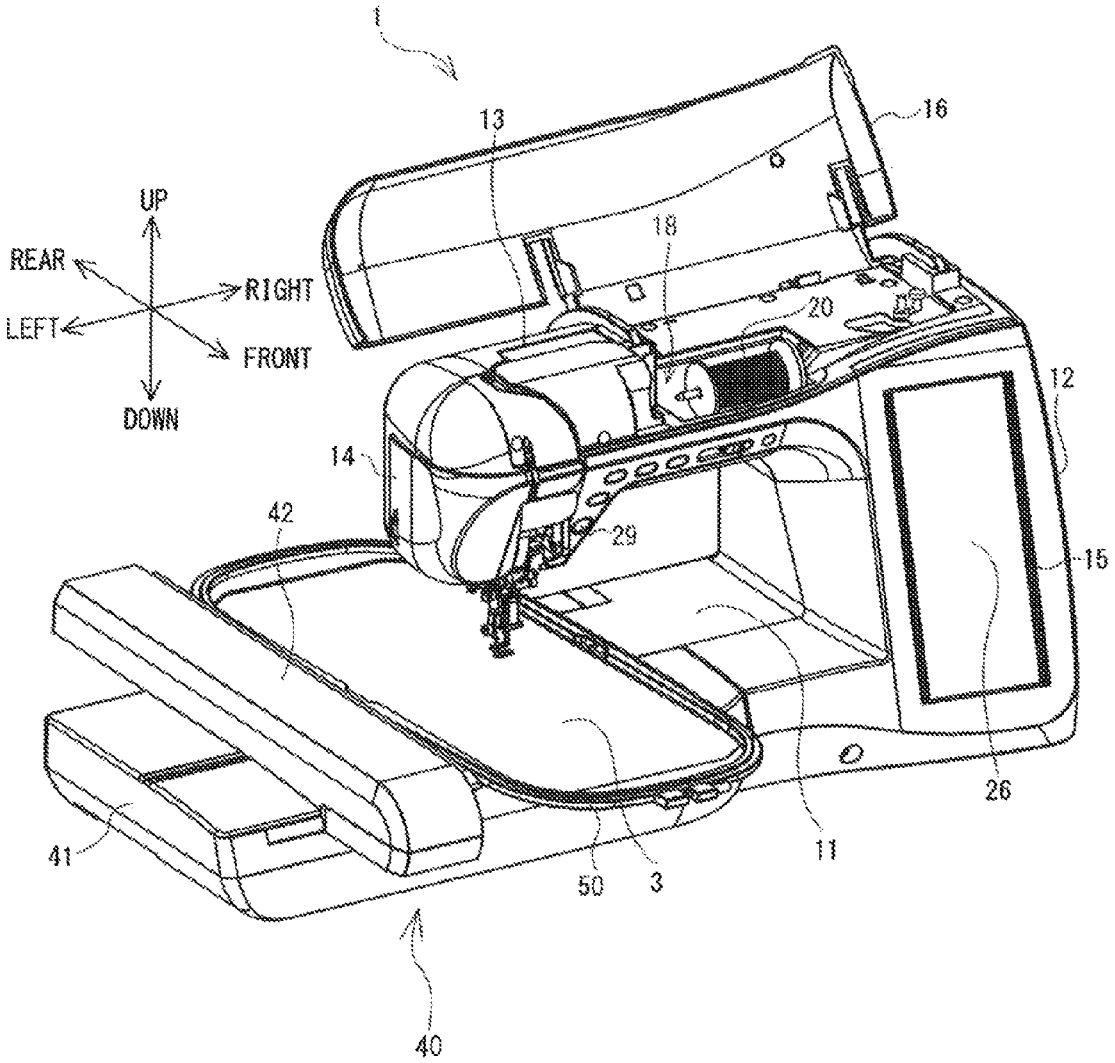
FIG. 1 is a perspective view of a sewing machine.

Hereinafter, an embodiment will be explained with reference to the drawings. A mechanical configuration of a sewing machine 1 will be explained with reference to FIG. 1 and FIG. 2. The up-down direction, the lower right side, the tipper left side, the lower left side and the upper right side in FIG. 1 respectively correspond to the up-down direction, the front side, the rear side, the left side and the right side of the sewing machine 1. Specifically, a surface on which a liquid crystal display 15 (that will be described later) is disposed is a front surface of the sewing machine 1. A lengthwise direction of a bed portion 11 and an arm portion 13 is the left-right direction, and a side on which a pillar 12 is disposed is the right side. An extending direction of the pillar 12 is the up-down direction of the sewing machine 1.

As shown in FIG. 1, the sewing, machine 1 is provided with the bed portion 11, the pillar 12, the arm portion 13 and a head portion 14. The bed portion 11 is a base portion of the sewing machine 1 and extends in the left-right direction. The pillar 12 is provided such that it stands upward from the right end portion of the bed portion 11. The arm portion 13 extends to the left from the upper end of the pillar 12 such that the arm portion 13 faces the bed portion 11. The head portion 14 is a portion that is connected to the left leading end portion of the arm portion 13.

A needle plate (not shown in the drawings) is provided on the top surface of the bed portion 11. The needle plate has a needle hole (not shown in the drawings). Although not shown in the drawings, the sewing machine 1 is provided with a feed dog, a feed mechanism and a shuttle mechanism etc., underneath the needle plate (that is, inside the bed portion 11). When normal sewing and not embroidery sewing is being performed, the feed dog is driven by the drive mechanism and moves the sewing workpiece (such as a work cloth) by a predetermined amount. The shuttle mechanism causes an upper thread (not shown in the drawings) and a lower thread (not shown in the drawings) to become entwined, below the needle plate.

The sewing machine 1 is further provided with an embroidery frame movement mechanism (hereinafter referred to as a "movement mechanism") 40. The movement mechanism 40 can be mounted on and detached from the bed portion 11 of the sewing machine 1. FIG. 1 shows a state in which the movement mechanism 40 is mounted on the sewing machine 1. When the movement mechanism 40 is mourned on the sewing machine 1, the movement mechanism 40 and the sewing machine 1 are electrically connected. The movement mechanism 40 is provided with a main body portion 41 and a carriage 42. The carriage 42 is provided on the upper side of the main body portion 41. The carriage 42 is a cuboid shape that is long in the front-rear direction. The carriage 42 is provided with a frame holder (not shown in the drawings), a Y-axis movement mechanism (not shown in the drawings), and a Y-axis motor 84 (refer to FIG. 3). The frame holder is provided on the right side surface of the carriage 42. A plurality of types of an embroidery frame 50 can be selectively and detachably mounted on the frame holder. The embroidery frame 50 has a known structure in which an inner frame and an outer frame clamp a sewing workpiece 3 and thus hold the sewing workpiece 3. When the embroidery frame 50 is moved to a sewing position that is exemplified in FIG. 1, the sewing workpiece 3 that is held by the embroidery frame 50 is arranged above the needle plate and below a needle bar 6 and a presser foot 9 that will be explained later. The Y-axis movement mechanism moves the frame holder in the front-rear direction (the Y-axis direction). The embroidery frame 50 moves the sewing workpiece 3 in the front-rear direction as a result of the movement of the frame holder in the front-rear direction. The Y-axis motor 84 drives the Y-axis movement mechanism.

An X-axis movement mechanism (not shown in the drawings) and an X-axis motor 83 (refer to FIG. 3) are provided inside the main body portion 41. The X-axis movement mechanism moves the carriage 42 in the left-right direction (the X-axis direction). The embroidery frame 50 moves the sewing workpiece 3 in the left-right direction as a result of the movement of the carriage 42 in the left-right direction. The X-axis motor 83 drives the X-axis movement mechanism. The movement mechanism 40 can move the embroidery frame 50 that is mounted on the carriage 42 to a position indicated by a unique XY coordinate system (an embroidery coordinate system). in the embroidery coordinate system, for example, the right side, the left side, the front side and the rear side of the sewing machine 1 are, respectively, the X-plus direction, the X-minus direction, the V-minus direction and the Y-plus direction.

The liquid crystal display (hereinafter referred to as the LCD) 15 is provided in the front surface of the pillar 12. An image that includes various items, such as commands, illustrations, setting values and messages, is displayed on the LCD 15. A touch panel 26, which can detect a pressed position, is provided on the front surface side of the LCD 15. When a user performs a pressing operation on the touch panel 26 using his/her finger or a stylus pen (not shown in the drawings) the pressed position is detected by the touch panel 26. Based on the detected pressed position, a CPU 61 (refer to FIG. 3) of the sewing machine 1 recognizes an item that has been selected on the image. Hereinafter, the pressing operation of the touch panel 26 by the user is referred to as a panel operation. Through the panel operation, the user can select a pattern that he/she wishes to sew, or select a command to be executed etc. A sewing machine motor 81 (refer to FIG. 3) is provided inside the pillar 12.

A cover 16 that can be opened and closed is provided on an upper portion of the arm portion 13. In FIG. 1 the cover 16 is in an open state. A thread storage portion 18 is provided below the cover 16, namely, inside the arm portion 13. The thread storage portion 18 can store a thread spool 20 around which the upper thread is wound. A drive shaft (not shown in the drawings) that extends in the left-right direction is provided inside the arm portion 13. The drive shaft is driven to rotate by the sewing machine motor 81. Various switches, including a start/stop switch 29, are provided on the left lower portion of the front surface of the arm portion 13. The start/stop switch 29 starts or stops the operation of the sewing machine 1. In other words, the start/stop switch 29 is used to input a command to start or to stop sewing.

Figure 2:
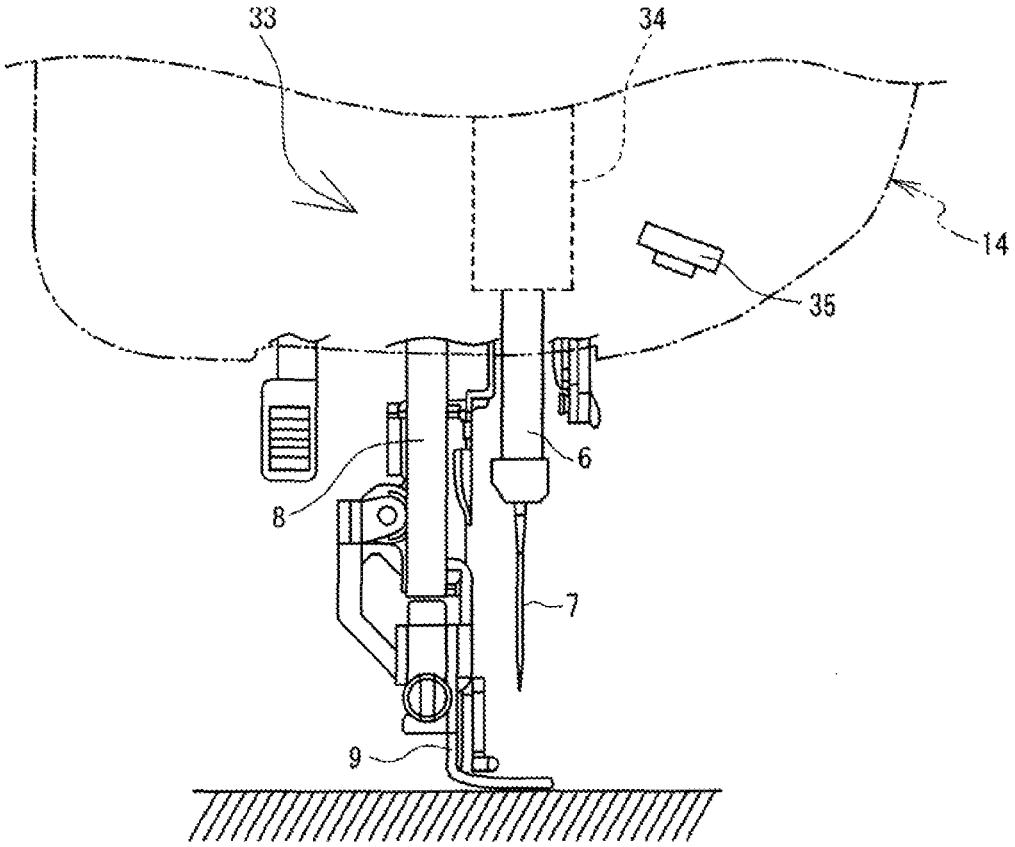
FIG. 2 is an explanatory diagram showing a configuration of a lower end portion of as bead portion of the sewing machine shown in FIG. 1.

As shown in FIG. 2, the needle bar 6, a presser bar 8 and a needle bar up-and-down mechanism 34 etc. are provided on the head portion 14. The needle bar 6 and the presser bar 8 extend downward from the lower end portion of the head portion 14. A sewing needle 7 is detachably mounted on the lower end of the needle bar 6. The presser foot 9 is detachably attached to the lower end portion of the presser bar 8. The needle bar 6 is provided on the lower end of the needle bar up-and-down mechanism 34. The needle bar up-and-down mechanism 34 drives the needle bar 6 to move in the up-down direction due to the rotation of the drive shaft. The sewing machine 1 is provided with the needle bar 6, the needle bar up-and-down mechanism 34 and the sewing machine motor 81 (refer to FIG. 3), as a sewing portion 33.

An image sensor 35 is provided inside the head portion 14. The image sensor 35 is, for example, a known complementary metal oxide semiconductor (CMOS) image sensor. The image sensor 35 captures an image of a predetermined image capture range and outputs image data of the captured image. The output image data is stored in a predetermined storage area of a RAM 63 (refer to FIG. 3). The image sensor 35 of the present embodiment can capture a rectangular range that is smaller than a sewable area The sewable area is an area in which stitches can he formed and is set as a rectangular shape on the inside of the inner frame of the embroidery frame 50. A coordinate system of an image represented by the image data generated by the image sensor 35 and a world space coordinate system (hereinafter referred to as a "world coordinate system") are associated with each other in advance using parameters stored in a flash memory 64. The world coordinate system and the embroidery coordinate system are associated with each other in advance using parameters stored in the flash memory 64. Thus, based on the image data, the sewing machine 1 can execute processing that identifies coordinates in the embroidery coordinate system.

Operations of the sewing machine 1 will be explained briefly. At the time of embroidery sewing, the embroidery frame 50 is moved in the left-right direction (the X-axis direction) and in the front-rear direction (the Y-axis direction) by the movement, mechanism 40, while the needle bar up-and-down mechanism 34 and the shuttle mechanism (not shown in the drawings) are driven at the same time. In this manner, an embroidery pattern is sewn on the sewing workpiece 3 that is held by the embroidery frame 50, by the sewing needle 7 that is mounted on the needle bar 6. The embroidery pattern includes a plurality of types of patterns and cross stitch patterns. At the time of sewing a normal practical pattern that is not the embroidery pattern, the sewing is performed while the feed dog (not shown in the drawings) moves the sewing workpiece 3 in a slate in which the movement mechanism 40 is removed from the bed portion 11.

Figure 3:
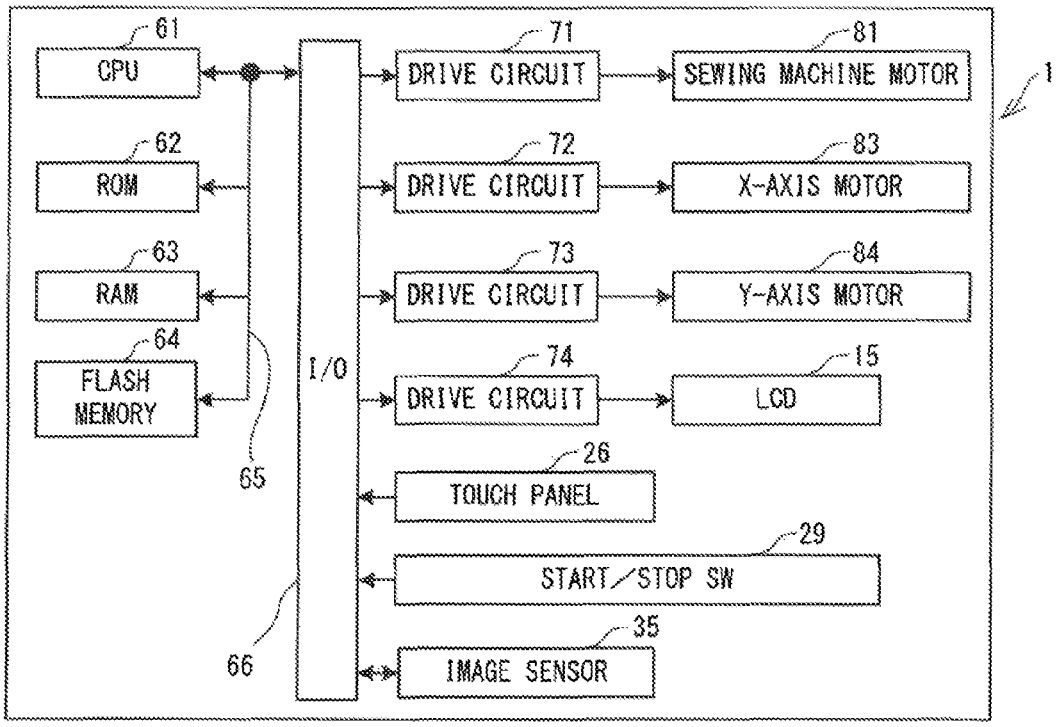
FIG. 3 is a block diagram showing an electrical configuration of the sewing machine shown in FIG. 1.

An electrical configuration of the sewing machine 1 will be explained with reference to FIG. 3. As shown in FIG. 3, the sewing machine 1 includes the CPU 61, a ROM 62, the RAM 63, the flash memory 64 and an input/output interface (I/O) 66. The ROM 62, the RAM 63, the flash memory 64 and the 110 66 are each electrically connected to the CPU 61 by a bus 65.

The CPU 61 performs overall control of the sewing machine 1 and performs various types of computations and processing related to sewing, in accordance with various programs stored in the ROM 62. Although not shown in the drawings, the ROM 62 is provided with a plurality of storage areas that include a program storage area and a pattern storage area. Various programs that are used to operate the sewing machine 1 are stored in the program storage area. The stored programs include, for example, a program that causes the sewing machine 1 to perform pattern sewing processing that will be explained later. Sewing data to perform sewing of various patterns are stored in the pattern storage area. The various patterns are cross stitch patterns, for example. Embroidery data includes a sewing order and coordinate data. The coordinate data represents coordinates on the embroider coordinate system (relative coordinates) of needle drop points that are used to sew the pattern. The needle drop points are points at which the sewing needle 7, which is disposed vertically above the needle hole (not shown in the drawings), pierces the sewing workpiece when the needle bar 6 is moved downward from above.

Storage areas that store computation results and the like from computational processing by the CPU 61 are provided in the RAM 63 as necessary. Various types of parameters and the like, for the sewing machine 1 to perform various types of processing, are stored in the flash memory 64. Drive circuits 71 to 74, the touch panel 26 the start/stop switch 29 and the image sensor 35 are connected to the I/O 66.

The sewing machine motor 81 is connected to the drive circuit 71 The drive circuit 71. drives the sewing machine motor 81 in accordance with a control signal from the CPU 61. In accordance with the driving of the sewing machine motor 81, the needle bar up-and-down mechanism 34 (refer to FIG. 2) is driven via the drive shah (not shown in the drawings) of the sewing machine 1, and the needle bar 6 is moved up and down. The X-axis motor 83 is connected to the drive circuit 72. The Y-axis motor 84 is connected to the drive circuit 73. The drive circuits 72 and 73 respectively drive the X-axis motor 83 and the Y-axis motor 84, in accordance with control signals from the CPU 61. In accordance with the driving of the X-axis motor 83 and the Y-axis motor 84, the embroidery frame 50 is moved in the left-right direction (the X-axis direction) and in the front-rear direction (the Y-axis direction) by a movement amount corresponding to control signals. The drive circuit 74 drives the LCD 15 in accordance with a control signal from the CPU 61 and thus causes images to be displayed on the LCD 15.

Figure 4:
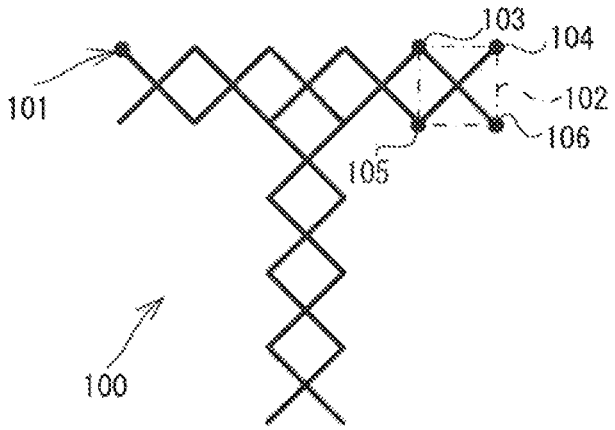
FIG. 4 is an explanatory diagram of a cross stitch pattern.

A cross stitch pattern 100 will be explained with reference to FIG. 4. The cross stitch pattern is a pattern formed by arranging a plurality of cross stitches side by side. The cross stitches are formed on two line segments that intersect at their respective centers, and are formed of a plurality of stitches. The above-described two line segments that intersect at their respective centers are referred to as a set of crossed. line segments. The set of crossed line segments corresponds to diagonal lines of a virtual square 102 shown in FIG. 4. The cross stitch pattern (hereinafter referred to as the pattern) 100 exemplified in FIG. 4 is a pattern represented using 9 sets of cross stitches and forms the letter T of the alphabet Embroidery data used to sew the cross stitch pattern is generated in accordance with to known method (such as that disclosed in Japanese Laid-Open Patent. Publication No. 2010-213748, for example). The left-right direction and the up-down direction in FIG. 4 respectively correspond to the X direction and the Y direction of the embroidery coordinate system. In order to simplify the explanation of the present embodiment, m the pattern 100 four needle drop points 103 to 106 are set at all end points of the set of crossed line segments (the vertices of the virtual square 102), and a needle drop point is not set at an intersection point (a center point of the virtual square 102) of the set of crossed line segments.

Figure 5:
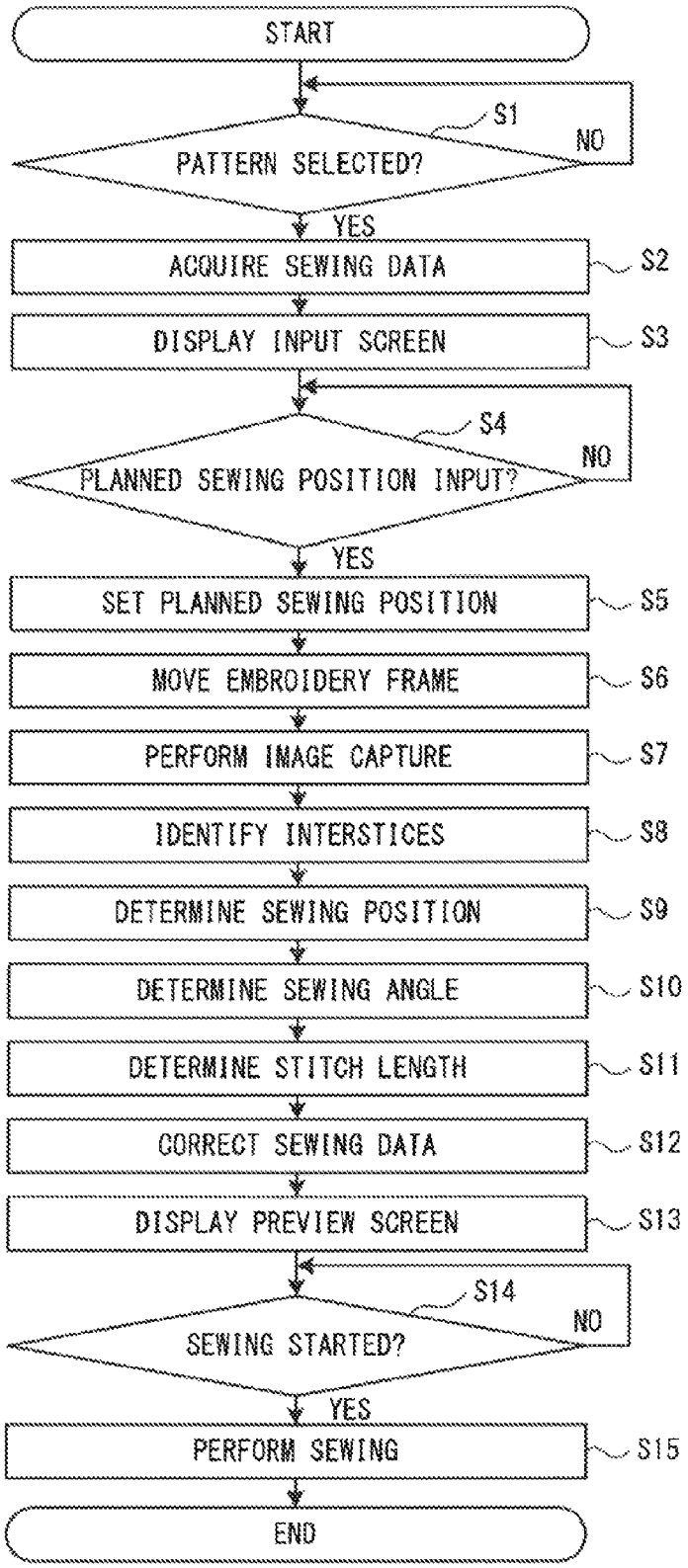
FIG. 5 is a flowchart of embroidery sewing processing.
Figure 6:
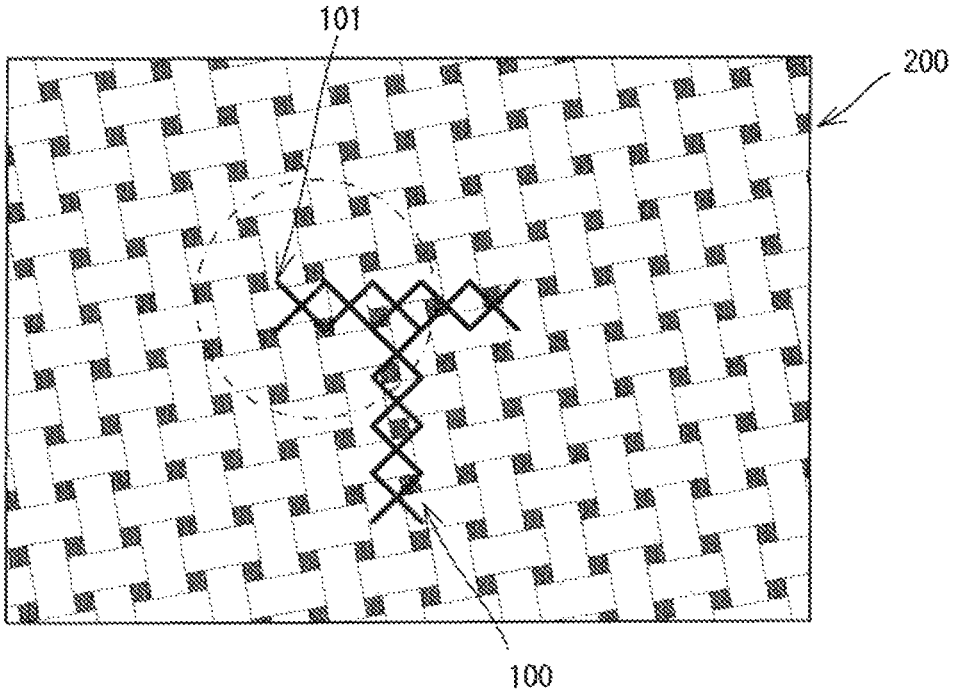
FIG. 6 is an explanatory diagram of an image represented by image data resulting from image capture of a sewing workpiece that is held by an embroidery frame.

Pattern sewing processing will be explained with reference to FIG. 4 to FIG. 7. When the user sews a cross stitch pattern on a special-purpose sewing workpiece for cross stitch patterns, the pattern sewing processing, shown in FIG. 5 is activated by the user inputting a start command by a panel operation. Examples of the special-purpose sewing workpiece for cross stitch patterns include a processed fabric (Aida cross stitch fabric, Indian cloth, Java cloth, Congress cloth etc.), and also include a synthetic resin sheet in which a plurality of small holes are farmed in a matrix, and so on. In the pattern sewing processing, processing is performed that adjusts a layout of the cross stitch pattern to match positions of interstices of the sewing workpiece. When the sewing workpiece is a woven fabric, the interstices of the sewing workpiece are gaps (small holes) between the warp threads and the weft threads. When the sewing workpiece is not a woven fabric (when it is the above-described synthetic resin sheet, for example), the interstices of the sewing workpiece are small holes that are formed in the sewing workpiece.

When the input of the start command is detected, the CPU 61 reads the program, which is used to execute the pattern sewing, processing and which is stored in the program storage area of the ROM 62 (refer to FIG. 3), to the RAM 63, and performs each step of the processing, as explained below, in accordance with instructions included M the program. Various data obtained in the course of the processing are stored, as necessary, in the RAM 63. The pattern sewing processing starts in a state in which the special-purpose sewing workpiece 3 for cross stitch patterns is mounted on the embroidery frame 50 and the embroidery frame 50 is mounted on the movement mechanism 40. Hereinafter, step will be abbreviated as S. In the present embodiment, in order to simplify the explanation, as a specific example of the pattern sewing processing that will be explained below, it is assumed that interstices are formed at uniform intervals in the sewing workpiece 3, in the lengthwise direction and the widthwise direction of the sewing workpiece 3.

As shown in FIG. 5, the CPU 61 stands by until selection of the cross stitch pattern is detected (no at S1). Although not shown in the drawings, an image that represents a plurality of mutually different cross stitch patterns is displayed on the LCD 15, based on the plurality of sewing data stored in the ROM 62. The user can select a desired cross stitch pattern by a panel operation. For example, when the CPU 61 detects that the pattern 100 shown in FIG. 4 has been selected (yes at S1), the CPU 61 acquires the sewing data to sew the pattern 100 from among the plurality of sewing data stored in the ROM 62 and saves the acquired sewing data to the RAM 63 (S2). The CPU 61 displays an input screen, which is used to input a planned sewing position, on the LCD 15 (S3).

Although not shown in the drawings, for example, an illustration that represents the sewable area is displayed on the input screen, and, while referring to the illustration, the user can input a desired position within the sewable area as the planned sewing position of the pattern 100. The CPU 61 stands by until the input of the planned sewing position is detected (no at S4). When the input of the planned sewing position has been detected (yes at S4), the CPU 61 sets the input position as the planned sewing position and stores the planned sewing position in the RAM 63 (S5). In the present embodiment, the planned sewing position is represented by coordinates on the embroidery coordinate system of a reference point of the cross stitch pattern selected at S1. As the reference point, one of the needle drop points used to sew the cross stitch pattern is set. More specifically, one of the four needle drop points on the end points of one of the plurality of sets of crossed line segments that form the cross stitch pattern is set. The reference point may be a needle drop point that is set in advance for each of the cross stitch patterns and stored in a storage device, such as the ROM 62 or the like. Alternatively, the reference point may be as needle drop point that is specified by the user. In order to simplify the explanation, in the pattern 100 shown in FIG. 4, of the plurality of needle drop points, the needle drop point at the top left in FIG. 4 is as reference point 101.

The CPU 61 controls the movement mechanism 40 and moves the embroidery frame 50 to an image capture position (S6), which is a position at which the planned sewing position of the cross stitch pattern selected at S1 is within the image capture range of the image sensor 35. More specifically, when the size of the cross stitch pattern is smaller than the image capture range, the CPU 61 sets, as the image capture position, a position in which the entire cross stitch pattern is within the image capture range. When the size of the cross stitch pattern is larger than the image capture range, the CPU 61 sets, as the image capture position, a position in which the reference point, of the cross stitch pattern is within the image capture range. The CPU 61 causes the image sensor 35 to generate image data representing the sewing workpiece 3 held by the embroidery frame 50 (S7). In the processing at S7. image data is acquired that represents an image 200 shown in FIG. 6, for example. in FIG. 6, in the image 200, an overlapped finished image is shown of as case in which the pattern 100 is sewn in the planned sewing position. Square shaped portions that are shaded in the image 200 are the interstices of the sewing workpiece 3. In the example shown in FIG. 6, the entire pattern 100 arranged in the planned sewing position is within the image 200.

Based on the image data acquired at S7, the CPU 61 identifies a position (coordinates) an the embroidery coordinate system of one or more interstices among the plurality of interstices of the sewing workpiece 3 (S8). The CPU 61 of the present embodiment identifies positions of two of the interstices. At S8, by performing image processing using known technology, a plurality of interstices are identified from the image. For example, a Hough transform is applied to the image 200 and a Hough transformed image is generated. Next, non-maximum suppression processing is performed on the Hough transform image and local bright points (in a mask) of the Hough transformed image are extracted. Then, of the extracted bright points, threshold processing is performed to extract only the bright points having a brightness greater than a predetermined threshold value, and the interstices are thus extracted. Of the identified plurality of interstices, the CPU 61 calculates the interstice that is closest to the reference point 101 of the pattern 100 that has been arranged in the planned sewing position. The CPU 61 then sets that closest interstice as a first reference interstice 201 (refer to FIG. 7). Among four interstices 202 to 205 that are closest in distance to the first reference interstice 201, the interstice that is positioned in the X-plus direction and the Y-plus direction, for example, is taken as a second reference interstice 202. The CPU 61 extracts an interstice center point, of each of the first reference interstice 201 and the second reference interstice 202, and calculates the coordinates on the embroidery coordinate system of the interstice center points. A known method is used, as appropriate, to calculate the coordinates on the embroidery coordinate system from the image (such as a method disclosed in Japanese Laid-Open Patent Publication No. 2011-5180, for example). Here, the coordinates of the first reference interstice 201 are $(X_1, Y_1)$ and the coordinates of the second reference interstice 202 are $(X_2, Y_2)$.

Based on a result of identifying the position of the at least one or more interstices identified S8 and on the planned sewing position acquired at 85 the CPU 61 determines a sewing position of the pattern 100 (S9). The CPU 61 determines the sewing position of the pattern 100 as a position at which the reference point 101 of the pattern 100 is a position of one of the interstices of the sewing workpiece 3. Specifically, the CPU 61 sets the coordinates of the reference point 101 of the pattern 100 to the coordinates $(X_1, Y_1)$ of the first reference interstice 201 identified at S8.

Figure 7:
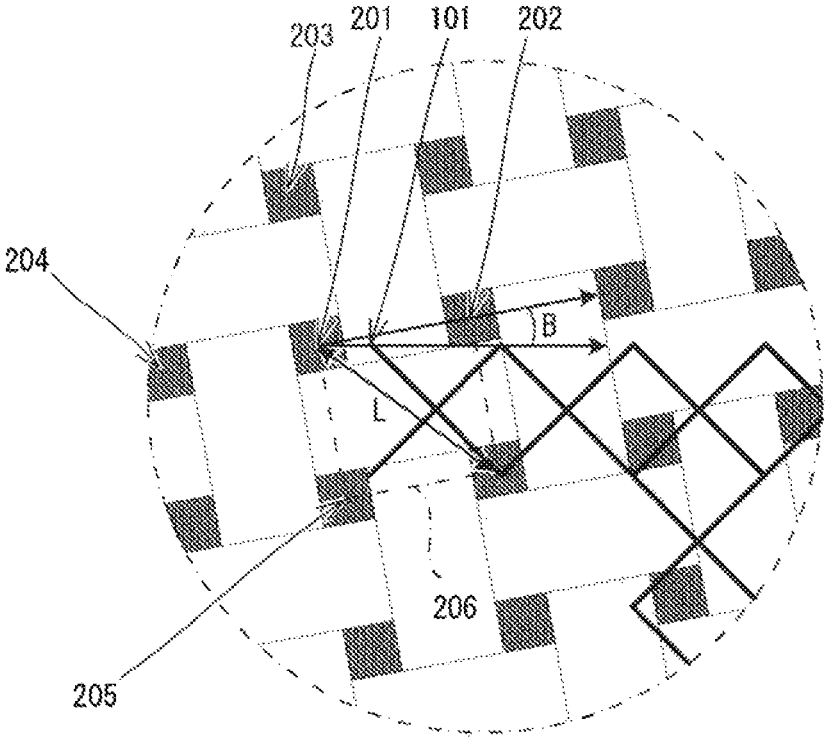
FIG. 7 is a partial enlarged view of a vicinity of a reference, point in the image shown in FIG. 6.

Based on a result of identifying the positions of the plurality of interstices identified by the processing at S8, the CPU 61 determines a sewing angle of the cross stitch pattern in the following manner (S10). As shown in FIG. 7, based on the result of identifying the coordinates of the first reference interstice 201 and the coordinates of the second reference interstice 202, the CPU 61 calculates an angle B of a line segment from the first reference interstice 201 toward the second reference interstice 202, with respect to the X-plus direction. More specifically, the CPU 61 can calculate the angle B using the following Expression (1).

$$B=\tan^{-1}((Y_2-Y_1)/(X_2-X_1)) \quad (1)$$

The CPU 61 sets a calculation result of the angle B as the sewing angle of the pattern 100.

Based on the identification result of the positions of the plurality of interstices identified by the processing at S8, the CPU 61 determines the length of each of the stitches included in the cross stitch pattern in the following manner (S11). The CPU 61 calculates a length L of a diagonal line of a virtual square 206, where a length of the side of the virtual square 206 is the distance between the first reference interstice 201 and the second reference interstice 202. More specifically, the CPU 61 can calculate the length L of the diagonal line using the following Expression (2).

$$L=\sqrt{2}\times\sqrt{((X2-X1)^2+(Y2-Y1)^2)} \quad (2)$$

The CPU 61 sets the calculated length L of the diagonal line as the length of each of the stitches representing the set of crossed line segments included in the cross Stitch pattern.

Based on the sewing position determined at S9, the sewing angle determined at S10, and the length of each of the stitches determined at S11, the CPU 61 corrects the sewing data acquired at S2 (S12). In other words, the CPU 61 corrects numerical values of the coordinates specifying the plurality of needle drop points included in the sewing data of the pattern 100. More specifically, the CPU 61 causes the sewing position, the sewing angle and the length of each of the stitches of the pattern 100 represented by the sewing data after the correction to match the sewing position, the sewing angle and the length of each of the stitches set by each of the above-described, processing steps. By the processing at S12, as will be explained later with reference to FIG. 8, the layout of the pattern 100 is corrected such that each of the end points of the sets of crossed line segments represented by the cross stitches included in the pattern 100 is aligned with one of the interstices of the sewing workpiece 3.

Figure 8:
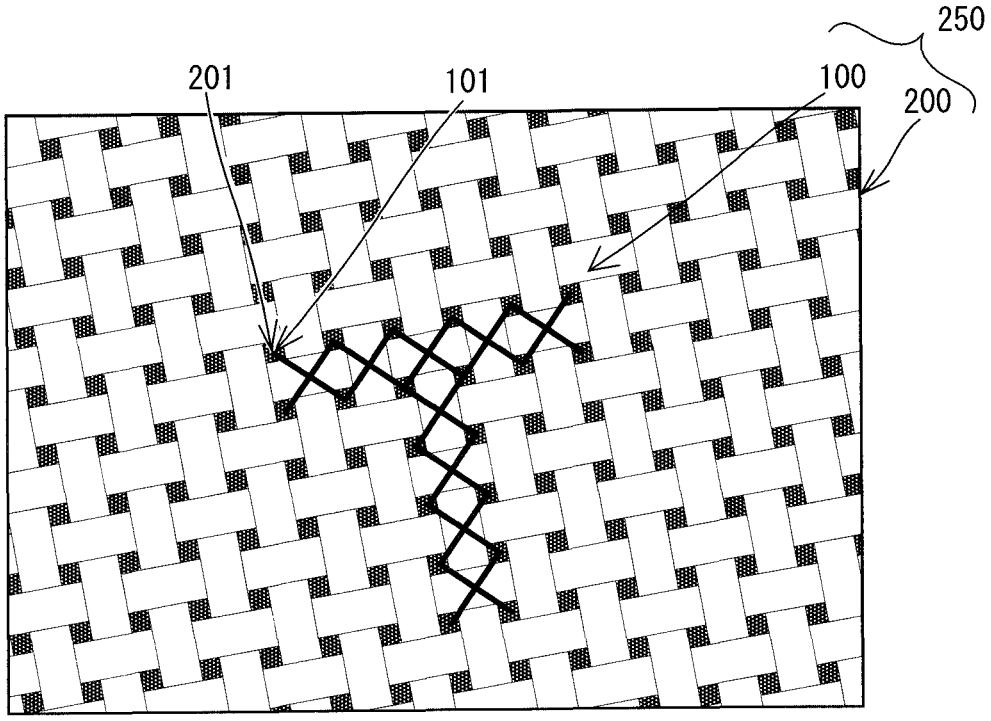
FIG. 8 is an explanatory diagram of an image showing a state in which the cross stitch pattern is arranged in accordance with corrected sewing data.

Based on the corrected sewing data, the CPU 61 displays a preview screen, which shows the layout of the pattern 100, on the LCD 15 (S13). On the preview screen, an image is displayed that shows the layout of the pattern 100 when the pattern 100 is to be sewn based on the corrected sewing data. For example, as shown in FIG. 8, an image 250 is displayed on the LCD 15. The image 250 is an image in which an illustration representing the pattern 100 is overlapped with the image 200 shown by the image data generated at S7. As shown in the image 250, the sewing position of the pattern 100 is set such that the reference point 101 of the pattern 100 matches the first reference interstice 201. The angle of the pattern 100 is obtained by rotating the pattern 100 in the anti-clockwise direction by the angle B around the reference point 101. As shown in FIG. 7, the length L of the diagonal line of the virtual square 206, whose side is the distance between the first reference interstice 201 and the second reference interstice 202, is set as the length of each of the stitches representing the sets of crossed line segments. In this case, the size of the pattern 100 is expanded to match the interval between the interstices.

The CPU 61 stands by until the input of the command to start the sewing is detected (no at S14). The command to start the sewing is input, for example, by a panel operation or by depressing the start/stop switch 29. The user inputs the command start the sewing after verifying the layout of the pattern 100 by referring to the preview screen. When the input of the command to start the sewing has been detected (yes at S14), the CPU 61 drives the sewing portion 33 and the movement mechanism 40 and causes the pattern 100 to be sewn on the sewing workpiece 3 (S15). The CPU 61 then ends the pattern sewing processing.

The sewing machine 1 can determine the sewing position of the cross stitch pattern while taking into account the positions of the interstices of the sewing workpiece 3. The sewing machine 1 can determine the sewing angle of the cross stitch pattern while taking into account an array layout direction of the interstices of the sewing workpiece 3. The sewing machine 1 can expand or contract the cross stitch pattern based on the interval between the interstices of the sewing workpiece 3, and can automatically change the length of each of the stitches included in the cross stitch pattern. In comparison to a case in which consideration is not given to the positions of the interstices of the sewing workpiece 3, the sewing machine 1 can improve the finish when sewing cross stitch patterns on the special-purpose sewing workpiece 3. In comparison to a case in which consideration is not given to the array layout direction of the interstices of the sewing workpiece 3, the sewing machine 1 can improve the finish when sewing cross stitch patterns on the special-purpose sewing workpiece 3. In comparison to a case in which consideration is not given to the interval between the interstices adjacent to each other on the sewing workpiece 3, the sewing machine 1 can improve the finish when sewing cross stitch patterns on the special-purpose sewing workpiece 3. The sewing machine 1 identifies the positions of the interstices based on the image data in which the image capture range including the planned sewing position is captured, and the sewing machine 1 can thus more accurately identify the positions of the interstices around the planned sewing position. The sewing machine 1 corrects the sewing data based On the positions of the interstices that have been more accurately identified, and thus the sewing machine 1 can further improve the finish when sewing cross stitch patterns on the special-purpose sewing workpiece 3. The sewing machine 1 sets the sewing position, the sewing angle and the length of the stitches of the cross stitch pattern based on the result of identifying the positions of two of the interstices among the plurality of interstices of the sewing workpiece 3. The sewing machine 1 can minimize the processing required to identify the positions of the interstices and can correct the layout of the cross stitch pattern to match the positions of the interstices of the sewing workpiece 3 in a relatively short time.

The sewing machine of the present disclosure is not limited to the above-described embodiment and various modifications may be added without departing from the spirit and scope of the present disclosure. For example, any one of the following modifications (A) to (C) may be added as appropriate.

(A) The configuration of the sewing machine 1 may be changed as appropriate. The sewing machine 2 may be an industrial sewing machine or a multi-needle sewing machine. It is sufficient that the imaging, device be a device that can generate image data and input the data to a control portion 60.

(B) The program that includes the instructions to execute the pattern sewing processing shown in FIG. 5 may be stored in a storage device of the sewing machine 1 until the sewing machine 1 executes the program. Thus, each of a method of acquiring the program, an acquisition path and a device storing the program may be changed as appropriate. The program that is executed by a processor of the sewing machine 1 may be received from another device via a cable or via wireless communication, and may be stored in a storage device, such as a flash memory or the like. The other device includes, for example, a PC and a server that is connected via a network.

(C) With respect to each of the steps of the pattern sewing processing shown in FIG. 5, the disclosure is not limited to the above example in which all of the steps are performed by the CPU 61 and some or all of the steps ma be performed by another electronic device (an ASIC, for example). Each of the steps of the above-described processing may be performed by a plurality of electronic devices (a plurality of CPUs, for example) through distributed processing. With respect to each of the steps of the pattern sewing processing of the above-described embodiment, the order of the steps can be changed, a step can be omitted and a step can be added as necessary. A case in which an operating system (OS) or the like, which operates on the sewing machine 1, performs some or all of the actual processing based on instructions from the CPU 61 of the sewing machine 1 and realizes the functions of the above-described embodiment by that processing is also included in the scope of the present disclosure. For example, the following modifications (C-1) to (C-3) may be added to the pattern sewing processing, as appropriate.

(C-1) The sewing data acquired at 52 may be sewing data to sew a cross stitch pattern that has been edited by the user using a known method. The sewing data acquired at 52 may be sewing data that is stored in an external storage device that is electrically connected to the sewing machine 1. At S5, the method of setting the planned sewing position may be changed as appropriate. The sewing machine 1 need not necessarily receive the input of the planned sewing position from the user and may set the planned sewing position to a position (a center of the sewable area, for example) that is determined in advance.

(C-2) The CPU 61 may omit the processing at S6 and may perform the image capture of the sewing workpiece at S7, in this case, based on an assumption that the interstices of the sewing workpiece are formed at uniform intervals, the sewing machine 1 may cause the image sensor 35 to capture an image of the sewing workpiece at a position that is not related to the planned sewing position (a predetermined position that is set in advance, for example), and may calculate positions of the interstices in the vicinity of the planned sewing position based on the image data of the captured image.

(C-3) Each of the method for determining the sewing position at S9, the method for determining the sewing angle at S10 and the method for determining the length, of the stitches at S11 may be changed as appropriate. The number of interstices whose positions are identified at S8 and the method of selection etc. may be changed as appropriate, depending, on the processing from S9 onward. At S9, the sewing position may be determined based. on a result of identifying positions of a plurality of the interstices. At S10, the sewing angle may be determined based on a result of determining positions of three or more of the interstices. The processing at S10 may be omitted. For example, when the sewing workpiece is held by the embroidery frame in a state in which the interstices (small holes) of the sewing workpiece are arranged at uniform intervals in parallel to the X-axis on the embroidery coordinate system, even if the processing at S10 is omitted, the same effects as in the above-described embodiment can be obtained. At S11, the length of stitches may be determined based on a result of identifying positions of three or more of the interstices. The processing at S11 may be omitted. For example, when the length of the crossed line segments is set to match the interval between the interstices of the sewing workpiece, even when the processing at S11 is omitted, the same effects as in the above-described embodiment can be obtained. When the interstices are not arranged at uniform intervals, the sewing machine 1 may, for example, identify the positions of all the interstices in the vicinity around a planned sewing range and may change a position of each of the needle drop points to match a position of each of the corresponding interstices.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to he illustrative. Various changes may he made without departing from the broad spirit and scope of the underlying principles.

What is claimed is:

1. A sewing machine comprising:

a sewing mechanism configured to sew an embroidery pattern on a sewing workpiece, the sewing mechanism including a needle bar, a needle bar up-and-down mechanism and a sewing machine motor, the needle bar up-and-down mechanism being configured to drive the needle bar to move in an up-down direction using a driving force of the sewing machine motor;

a movement mechanism including a frame holder, an X-axis motor and a Y-axis motor, the frame holder being configured such that an embroidery frame holding the sewing workpiece can be detachably mounted thereon, the movement mechanism being configured to move the embroidery frame when the embroidery frame is mounted on the frame holder to an X direction using a driving force of the X-axis motor and to a Y direction using a driving force of the Y-axis motor;

an imaging portion configured to capture an image of the sewing workpiece held by the embroidery frame and to generate image data; and a processor programmed to cause the sewing machine to perform processes comprising:

acquiring sewing data to sew a cross stitch pattern, the cross stitch pattern being formed by arranging a plurality of cross stitches side by side, each of the cross stitches being stitches formed on two line segments intersecting each other at their respective centers, the sewing data including coordinate data of a plurality of needle drop points;

setting a planned sewing position of the cross stitch pattern;

causing the imaging portion to generate an image data representing the sewing workpiece held by the embroidery frame before sewing based on the acquired sewing data;

identifying positions of a first interstice and a second interstice from among a plurality of interstices on the sewing workpiece based on the generated image data, each of the plurality of interstices being a gap between warp threads and weft threads, the gap already existing on the sewing workpiece before sewing based on the acquired sewing data, the first interstice being closest interstice to a reference point of the cross stitch pattern arranged in the planned sewing position, the reference point being one of the plurality of needle drop points, the second interstice being one of the plurality of interstices separately from the first interstice;

determining a sewing position of the cross stitch pattern as a position at which the reference point of the cross stitch pattern is a position of the first interstice;

determining a sewing angle of the cross stitch pattern based on an angle of a line segment connecting the first interstice and the second interstice with respect to the X direction;

correcting the coordinate data of the plurality of needle drop points included in the sewing data based on the determined sewing position and the determined sewing angle; and driving the movement mechanism to move the embroidery frame at a point indicated by the corrected coordinate data and the sewing mechanism to move the needle bar down-up at the indicated point, such that the cross stitch pattern is sewn on the determined sewing position of sewing workpiece at the determined sewing angle, the determined sewing potion being a position where the reference point of the cross stitch pattern is on the first interstice.

2. The sewing machine according to claim 1, wherein the processor is programmed to further cause the sewing machine to perform processes comprising:

determining a length of the stitches of the cross stitch pattern based on the identified positions of the first interstice and the second interstice; and correcting the sewing data based on the sewing position, the sewing angle and the determined length of the stitches.

3. The sewing machine according to claim 1, wherein the processor is programmed to further cause the sewing machine to perform a process comprising:

driving the movement mechanism such that the embroidery frame is moved to an image capture position, the image capture position being a position at which the reference point of the cross stitch pattern arranged in the planned sewing position is included in an image capture range of the imaging portion;

causing the imaging portion to generate an image data representing the sewing workpiece held by the embroidery frame positioned in the image capture portion before sewing based on the acquired sewing data; and identifying positions of the first interstice and the second interstice from among the plurality of interstices on the sewing workpiece positioned in the image capture portion based on the generated image data.

4. The sewing machine according to claim 2, wherein the processor is programmed to cause the sewing machine to perform a process comprising:

calculating a length of a diagonal line of a virtual square, where a length of the side of the virtual square is the distance between the first interstice and the second interstice;

determining the length of the stitches of the cross stitch pattern as the calculated length of the diagonal line; and correcting the sewing data based on the sewing position, the sewing angle and the determined length of the stitches, the determined length being determined as the calculated length of the diagonal line.

* * * * *